US005875575A

United States Patent [19]

Pember

[11] Patent Number: 5,875,575

[45] Date of Patent: Mar. 2, 1999

[54] LASER LICENSE PLATE COVER

[76] Inventor: Scott N. Pember, 218 Sleepy Hollow Dr., Amherst, Ohio 44001

[21] Appl. No.: 248,745

[22] Filed: May 25, 1994

[51] Int. Cl.[6] ..... G09F 7/00; H01Q 17/00

[52] U.S. Cl. ..... 40/200; 40/209; 342/1

[58] Field of Search ..... 40/200, 209; 428/492, 428/494, 495; 342/1, 2, 3; 359/885, 890

[56] References Cited

U.S. PATENT DOCUMENTS

| | | | |
|---|---|---|---|
| 3,315,394 | 4/1967 | Kluck | 40/209 |
| 3,611,605 | 10/1971 | Baker | 40/209 |
| 3,867,776 | 2/1975 | Drummond et al. | 40/209 |
| 4,270,287 | 6/1981 | Gimbel | 40/209 X |
| 4,473,826 | 9/1984 | Pusch et al. | 342/3 X |
| 4,902,738 | 2/1990 | Mitsuno et al. | 524/525 |
| 4,948,922 | 8/1990 | Varadan et al. | 342/1 X |
| 5,275,925 | 1/1994 | Mihara et al. | 430/495 X |
| 5,381,618 | 1/1995 | Singleton | 40/209 X |
| 5,389,434 | 2/1995 | Chamberlain et al. | 342/1 X |

OTHER PUBLICATIONS

Car and Driver, "Do Laser Detectors Work?", Dec. 1992, pp. 133–137.

Schroeder, Don, "How To Beat Laser and Radar Guns", Nov. 1993, vol. 39 page 124.

Sherman, Don, "Speeders Beware: It's The Photo and Laser Cops", Popular Science, Sep. 1990, pp. 66–69 and p. 104.

"LTI 20–20", Laser Speed Detection System Operator's Manual, Laser Technology Inc.

Glendale Laser Eye Protection, Advertisement Pamphlet.

*Primary Examiner*—Peter M. Cuomo
*Assistant Examiner*—James O. Hansen
*Attorney, Agent, or Firm*—Fay, Sharpe, Beall, Fagan, Minnich & McKee

[57] ABSTRACT

A license plate cover is provided with laser absorptive features. As a laser beam, having a predetermined wavelength which matches the absorptive properties of the plate cover, impinges on the plate cover the laser beam energy is absorbed on a molecular level and converted to heat thereby decreasing or eliminating the reflection of the transmitted laser beam.

6 Claims, 3 Drawing Sheets

LASER LICENSE PLATE COVER

BACKGROUND OF THE INVENTION

The present invention relates to the art of laser light absorption. It finds particular application in conjunction with absorbing a laser beam directed at a moving vehicle, thereby decreasing the distance at which a speed detection device using a laser beam is effective. It is to be appreciated, however, that the invention may find application in other areas.

Numerous devices for detecting the speed of a traveling vehicle have been presented. Included among these is a system known as VASCAR, which is an acronym for Visual Average Speed Computer and Recorder. In its simplest form VASCAR is a calculator that determines a target car's speed from two factors, time and distance. With VASCAR a user implements two toggle switches to "clock" a car, one to start and stop a distance measurement and the other begins and ends the time measurement. The time basis is internal, while a sensor connected to the user's speedometer cable supplies distance information. A user will simply measure the length of the area over which the test will be done, which may be a span of roadway. Then, by flipping the switch twice, the user determines how long it takes a target car to cover the predetermined length. An internal calculator does the mathematical calculations and the average speed is displayed on a LED readout.

Another detection method uses radar (radio detection and ranging). A radar gun antenna transmits a microwave signal at the target vehicle, which reflects a portion of the wave back to the "gun". If both cars are moving at the same speed, the reflected wave will be the same frequency as this transmitted signal.

But if the target car is moving relative to the user's car, it will bounce waves back at a slightly different frequency, higher if the target is approaching, lower if the car is receding. The car's speed can be accurately determined by comparing the transmitted frequency of the outgoing beam with its echo. A microwave beam used in radar detection can be more than 200 feet wide at a distance of 2,000 feet, enough to cover several highway lanes, therefore, bringing into question which vehicle of a group of vehicles is being targeted.

A recent advancement in the detection of vehicle speeds is the use of a laser beam. Laser is an acronym for Light Amplification by Stimulated Emission of Radiation. A laser beam will form only a 5½ foot spot at a distance of 2,000 feet and can, therefore, be aimed directly at a car being targeted. A commonly used type of arrangement for a laser beam to detect moving automobiles is in the form of a "gun" which uses a gun site to target its beam of light on a specific car. Approximately every three milliseconds some laser "guns" can calculate how far away the car is based on the time it takes the beam of light to make a round trip. Speed is then determined by dividing the change in distance by the elapsed time between readings.

In the article "How To Beat Laser and Radar Guns" *Car and Driver*, November 1993, Vol. 39, page 124 (4), by Don Schroeder, operation of two commonly used laser or lidar guns are discussed. These include the Kustom Signals ProLaser and the LTI 20-20. Both use pulses of infrared laser light at approximately a 904-nanometer wavelength in order to measure speed. The gun fires each pulse at the target and will wait for its reflection to return. With these products the laser beam created by the pulses is very narrow, about four (4) feet wide at a thousand (1,000) feet. The pulses are also very short approximately thirty-five billionths of a second long and are fired very rapidly, as many three hundred and eighty-five (385) times a second for the ProLaser.

The above article notes that the LTI 20-20 can clock a car a half a mile away in about a one-third (½) of a second. Another related article "Do Laser Detectors Work?", *Car and Driver*, December 1992, pages 133–135, by Don Schroeder states tests done with the same devices were able to a clock a highly reflective car from a mile away.

Various methods and devices are discussed in these articles to detect or limit the effectiveness of laser guns. A commonly used device is a laser detector, an electronic device for detecting the presence of a laser beam. This is a highly complex piece of equipment which is mounted on the dash or grill of a car and attempts to warn a driver as to the use of a laser gun. In addition to laser detectors, the article "How To Beat Laser and Radar Guns" suggests that by turning on the lights of a vehicle, the effectiveness of a laser gun is diminished. This occurs since certain car lights emit not only visible light on the electromagnetic spectrum but also infrared light.

"How To Beat Laser and Radar Guns" also explained that removal of the license plates decreases the laser guns capabilities. As more and more cars are using plastic in their construction the license plate has become a prime reflective surface for the laser beam. In fact, literature regarding operation of the LTI 20-20 specifically instructs a user to measure the velocity of a vehicle by aiming the laser gun at the license plate area of the target vehicle. This operation is described in Laser Speed Detection System Operator's Manual LTI 20-20 from Laser Technology, Inc. 7399 South Tucson Way, Level B Englewood, Colo. 80112.

As previously discussed, "How To Beat Laser and Radar Guns" has found that emissions from car lights, especially high beams, was effective in lowering the useful range of laser guns. This article further noted, however, that by using additional lighting, interference with other drivers would likely occur. One way which was shown to eliminate this interference is to use a filter that absorbs the bright visible light but passes the invisible infrared light. The article concluded that by using a laser detector with the headlights and driving lights on, chances are significantly decreased that either laser gun described in the article, will receive an accurate first reading. Thus, a laser detector would then have time to sound an alarm prior to a useable reading, allowing the driver time to decelerate.

It should be noted that one of the most effective manners described in the above articles to decrease the useful range of a laser gun is removal of the license plate. However, since in all states both front and rear license plates or at least a rear license plate is required, this is not a practical solution.

The use of high-beams or powerful driving lights also has drawbacks including interference with other drivers. A suggestion to overcome this drawback is the use a filter that absorbs the bright visible light but passes the invisible infrared. Unfortunately, as also noted in the article, using such a filter would mean the light does not allow visible light to pass through. This would then require a user to remove the filters whenever visible light is desired, such as night driving. Another drawback with this solution is that the car lights would be used continuously, this would result in the lights burning out at a faster rate than would otherwise occur. Further, such constant use of the lights could put an undesirable drain on the vehicle's battery.

The present invention provides a new and improved license cover plate which will absorb laser light thereby decreasing the working range of a laser gun while overcoming the problems of other attempts to decrease the working range of a laser gun.

SUMMARY OF THE INVENTION

In accordance with one aspect of the present invention, an apparatus for decreasing the effective range of a laser gun is provided. A substantially flat piece of laser absorptive material is placed in front of and substantially adjacent to a license plate. The laser absorptive material is constructed to absorb laser beam light in a range substantially the same as that used by a laser gun. An attaching device is used for attaching the substantially flat piece of laser absorptive material to the license plate.

In accordance with another aspect of the present invention, a method of decreasing the effective range of a laser detector device is provided by forming a laser absorptive material constructed to absorb at wavelengths produced by a laser beam emitted by a laser gun. The laser absorptive material is made in a substantially flat configuration having an area sufficient to substantially cover the metallic facing of a license plate. The substantially flat piece of laser absorptive material is thereafter attached in operative connection with the license plate.

In accordance with another aspect of the invention, the laser absorptive material is made of a polymer with homogeneously dissolved additives to absorb laser energy.

In still a more limited aspect of the present invention, the substantially flat surfaced piece of laser absorptive material absorbs laser beams in the 900 to 1000 nanometer range.

One advantage of the present invention is that by absorbing a laser beam emitted by a laser gun the distance at which the speed of the subject vehicle may be accurately detected is greatly decreased.

Another advantage of the present invention is that its operation does not require any substantial maintenance by a user.

Still another advantage of the present invention resides in the ease with which it may be implemented.

Further advantages of the present invention will become apparent to those of ordinary skill in the art upon reading and understanding of the following detailed description of the preferred embodiment.

BRIEF DESCRIPTION OF THE DRAWINGS

The present invention may take form in various parts and arrangements of parts or in various steps and arrangements of steps. The drawings are only for purposes of illustrating a preferred embodiment and are not to be construed as limiting the invention.

DETAILED DESCRIPTION OF THE PREFERRED EMBODIMENT

Figure 1:
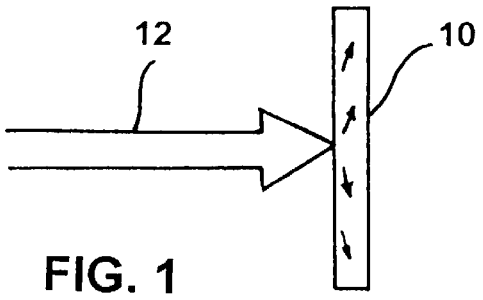
FIG. 1 is a diagrammatic illustration of the functioning of an absorptive material.

With reference to FIG. 1 it is noted that with absorptive material 10 as that used in the present invention, when a laser beam 12 impinges upon this material much of the laser beam's energy is absorbed on a molecular level and converted to heat which is then dissipated. Since it is absorbed there is no reflective light from the laser beam and, regardless of the angle of incident at which the beam hits the material, the laser energy is fully absorbed by the filtering of the material. The absorbers, such as rubber compounding material HVA-2, NDBC-D and Sebacic acid di-k salt, used to make this absorptive material are integrated into polymers having homogeneously dissolved additives to effectively absorb the laser energy. Since these absorptive features are an integral part of the filter, scratches will not effect the absorptive nature.

The surface of the material may be coated on both sides with an anti-abrasion layer to protect them from surface scratches to ensure maximum service life. The use of a plastic or polymer based license plate cover instead of a glass type cover adds to the life of the license plate cover allowing the cover to absorb nicks and dents which will occur in normal use. Such absorptive materials are well known and are produced under various names and by various companies including Glendale Protective Technologies of the Bilsom Group of Lakeland Fla.

The absorbers integrated into the polymers may be selected from a wide range in order to absorb specific laser frequencies. Presently, laser guns now in use operate in the 900 nanometer range, and more specifically at 904 nanometers. Therefore, the absorptive properties of the subject invention are constructed to match these wavelengths. Though the material being used will absorb wavelengths between 900–1000 nanometers the material is transparent at visible light wavelengths. In one embodiment a green tint will exist, however, the license plate will be visible through the material. It is to be appreciated having absorptive capabilities at different wavelengths are possible.

Figure 2:
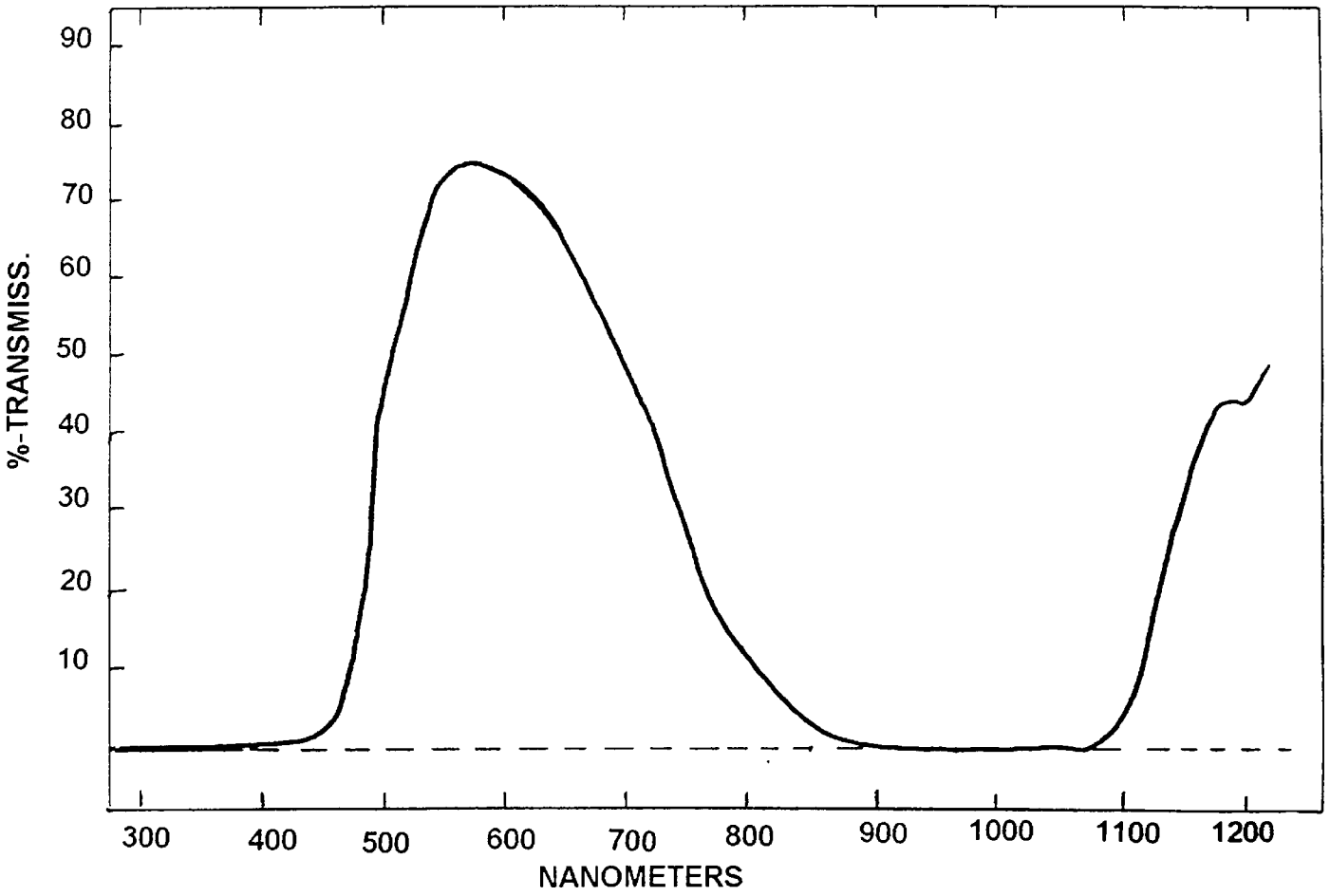
FIG. 2 is a graph of a particular absorptive material which may be used in the present invention.

FIG. 2 sets forth a graph of depicting the operation of an absorptive material used in the present invention. The graph plots the response of the material as a percentage of the laser beam light transmitted through the material, at varying laser beam wavelengths (in nanometers). As shown by FIG. 2, when the laser beam wavelength is within the 900 to 1,000 nanometer range substantially zero percentage of the beam is transmitted through the material. On the otherhand, when a beam at approximately 550 nanometers is aimed at the material approximately 75% of this beam will be transmitted.

Figure 3:
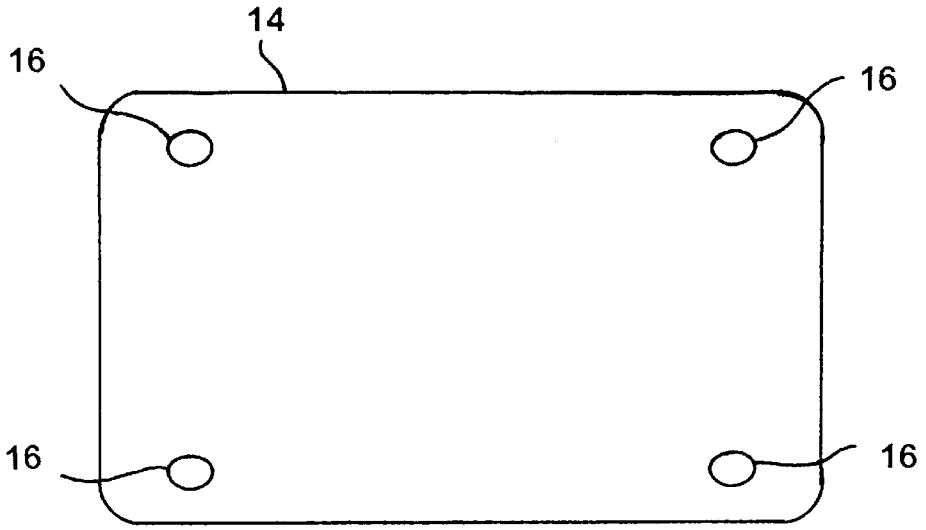
FIG. 3 is a diagrammatic front view of an exemplary license plate cover in accordance with the present invention.
Figure 4:
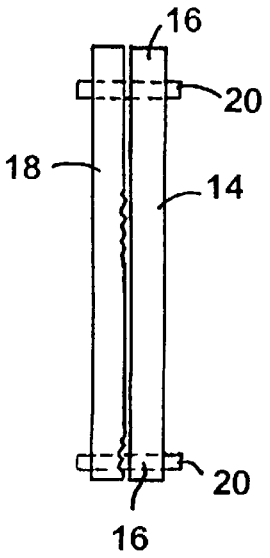
FIG. 4 is a side view of a first embodiment of the present invention in operative connection with the license plate; and, FIG. 5 is a second embodiment of the present invention wherein the absorptive material is held in a plate holder.

FIG. 3 shows a front view of a license plate cover 14 made of the absorptive material according to the present invention. The cover is formed to be substantially equal to the size of a vehicle license plate has a thickness of approximately ⅛ to ¼ of an inch. To attach the license plate cover, made of the appropriate absorptive material, holes 16 are formed within the cover. As can be seen in FIG. 4 these holes 16 are placed to match with holes in a license plate 18. In this manner license plate cover 14 may be placed in close operative connection with license plate 18 and then secured. A common manner of securing would be to use screws 20 to secure the cover 14 to the plate 18. While these screws may be of metal, it would be more beneficial to use a plastic or other non-reflective screw type connector.

Figure 5:
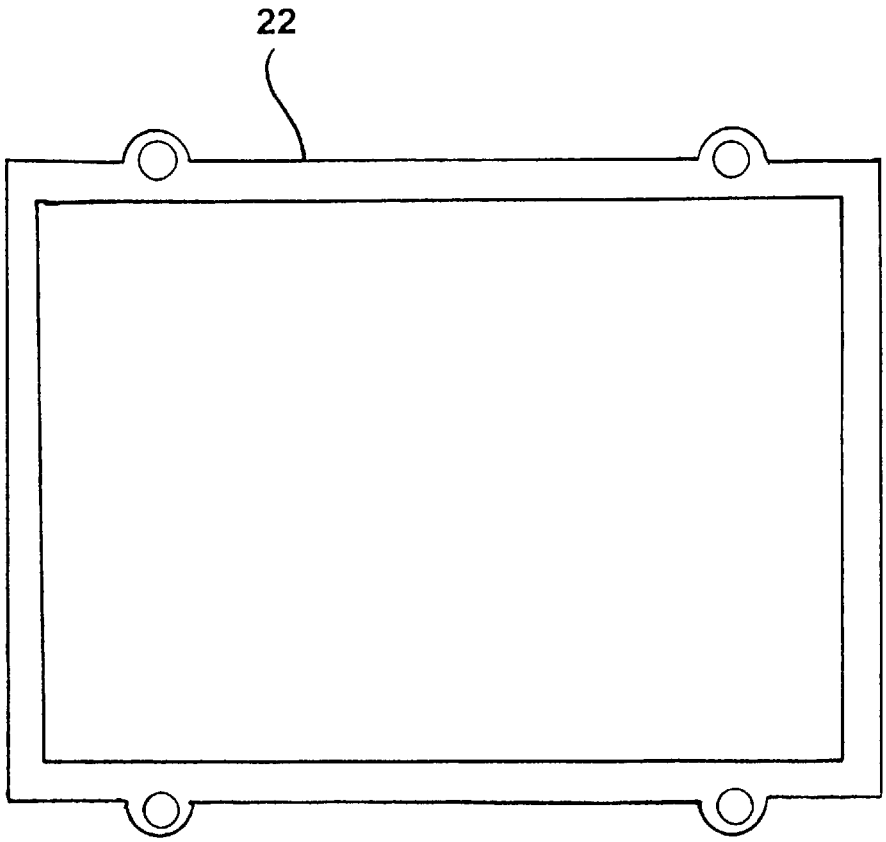

Another embodiment of the present invention provides for a plate cover holder 22 illustrated in FIG. 5. The absorptive material 14 is moved into the plate cover holder 22, and the holder is attached to the vehicle by a screw or other attaching arrangement similar to that previously disclosed. Plate cover holder 22 is preferably made out of a plastic material.

Figure 6:
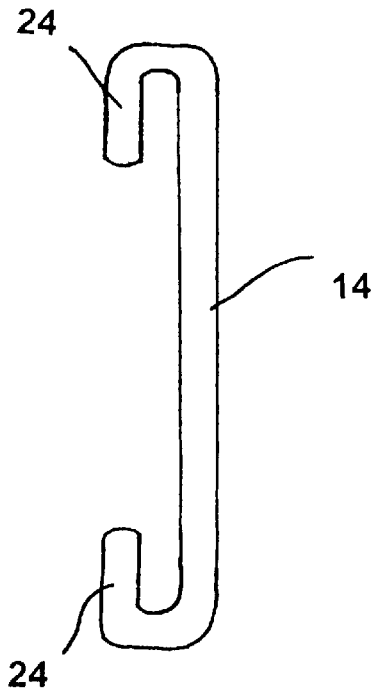
FIG. 6 is a second embodiment of the present invention having hook members used for engaging the license plate.

An example of another type of connection is shown in FIG. 6. Hook members 24 are included as part of license plate cover 14. These hook members may be made of the same material as the license plate cover 14, i.e. the absorptive material or another type of material, and, the entire plate may then be manufactured as a single integrated body. Alternatively, the hook members 24 may be separately formed of another type of material and thereafter attached to plate cover 14. The attachment of the hook members 24 to plate cover 14 may be through a screw, adhesive or other commonly known attaching arrangements.

Applicant has tested the above license plate cover 14. The results of these tests are set forth below. Particularly, three (3) different types of vehicles were tested, i.e. a Bonnieville, a Grand Prix and a Trans Port. These vehicles were tested in situations where the license plates on the cars were removed; a situation where a plate with the subject laser cover 14 was attached; and where a laser cover 14 is attached over a license plate and the high beams of the car were turned on. Further a "base" measurement was taken which represents the longest range of detection by a laser gun. This "base" measurement was undertaken with no cover over the license plate and the high beams turned off. Under the "base" test each of the vehicles were detected at approximately 3,099 feet.

Thereafter, three (3) separate tests for each vehicle under each of the above situations was performed. For instance, the Bonnieville was tested with no license plate and was detected at 850, 950 and 966 feet. Then a test with the license plate having the plate cover was undertaken. Under these conditions the Bonnieville was detected at 780, 800 and 1,100 feet respectively. Lastly, with the plate cover over the license plate and the high beam lights on, the Bonnieville was detected at 750, 800 and 810 feet.

The laser gun used to perform these tests was the LTI 20-20 which has the longest range of the most popular laser guns available.

TEST RESULTS FOR T 3 ALPHA LASER LICENSE PLATE COVER

| | No Plate | Plate W/T 3 | Cover W/Hi Beams | Plate (Base) |
|---|---|---|---|---|
| Bonnieville | 850, 950 966 | 780, 800 1100 | 750, 800, 810 | 3099 |
| Grand Prix | 1150, 1200 1500 | 757, 810 1100 | 440, 550, 555 | 3099 |
| Trans Port | 1408, 1505 1578 | 1250, 1300 1308 | 738, 770, 810 | 3099 |

*All test in feet. T 3 alpha positioned on front plate. Plate (base) represents the longest range achieved in our test by the gun to clock the vehicles. LTI 20-20 laser gun used. (This gun has the longest range of the two widely available).

From the above, it may be noted that a significant decrease occurs when using the license plate cover as opposed to not using the cover. This decrease in effective range will assist, when used in conjunction with a laser detector, to allow a user to adjust the speed at which they are traveling prior to a verified speed detection by a laser gun.

The invention has been described with reference to the preferred embodiment. Obviously, modifications and alterations will occur to others upon reading and understanding the preceding detailed description. It is intended that the invention be construed as including all such alterations and modifications insofar as they come within the scope of appended claims or the equivalence thereof.

Having thus the preferred embodiment, the invention is now claimed to be:

1. A license plate cover apparatus for decreasing an effective range of a speed detection device using a laser beam, the license plate cover apparatus comprising:

a substantially flat piece of laser absorptive material constructed of a polymer and homogeneously dissolved additives such that substantially all of visible light passes through the material and laser energy of a laser beam of a predetermined wavelength is at least 60% absorbed by the material, wherein the material is sized to cover a vehicle license plate; and an attaching means for attaching the substantially flat piece of laser absorptive material to a front face of the vehicle license plate.

2. The license plate cover according to claim 1 wherein the attaching means is a plate cover holder.

3. The license plate cover according to claim 1 wherein the attaching means includes, a plurality of holes arranged to correspond to holes existing in the license plate; and screws which secure the absorptive material and the license plate to the vehicle through the holes.

4. The license plate cover according to claim 1, wherein the homogeneously dissolved additives include absorbers including at least one of rubber compound HVA-2, NDBC-D and sebacic acid di-K salt.

5. The license plate cover according to claim 1 wherein the attaching means are a plurality of hook members, which engage edges of the license plate.

6. The license plate cover according to claim wherein the laser absorptive material is configured to absorb more than 90% of laser energy of a laser beam in the 900 to 1000 nanometer range.

* * * * *